US010796641B2

(12) United States Patent
Yang et al.

(10) Patent No.: US 10,796,641 B2
(45) Date of Patent: Oct. 6, 2020

(54) PIXEL UNIT CIRCUIT, PIXEL CIRCUIT, DRIVING METHOD AND DISPLAY DEVICE

(71) Applicant: BOE TECHNOLOGY GROUP CO., LTD., Beijing (CN)

(72) Inventors: Shengji Yang, Beijing (CN); Xue Dong, Beijing (CN); Xiaochuan Chen, Beijing (CN); Hui Wang, Beijing (CN); Yanming Wang, Beijing (CN); Minghua Xuan, Beijing (CN); Pengcheng Lu, Beijing (CN); Wei Liu, Beijing (CN); Kuanta Huang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/335,024

(22) PCT Filed: Jun. 21, 2018

(86) PCT No.: PCT/CN2018/092130
§ 371 (c)(1),
(2) Date: Mar. 20, 2019

(87) PCT Pub. No.: WO2019/029278
PCT Pub. Date: Feb. 14, 2019

(65) Prior Publication Data

US 2019/0251905 A1 Aug. 15, 2019

(30) Foreign Application Priority Data

Aug. 11, 2017 (CN) ..... 2017 1 0684866

(51) Int. Cl.
*G09G 3/3233* (2016.01)
*G09G 3/3258* (2016.01)
*G09G 3/3225* (2016.01)

(52) U.S. Cl.
CPC ..... *G09G 3/3258* (2013.01); *G09G 3/3225* (2013.01); *G09G 2320/0257* (2013.01);
(Continued)

(58) Field of Classification Search
CPC ..... G09G 3/3258; G09G 2300/0819; G09G 2300/0842; G09G 2300/0861;
(Continued)

(56) References Cited

U.S. PATENT DOCUMENTS

2011/0019053 A1* 1/2011 Nishihara ..... H04N 5/357 348/311
2015/0221252 A1 8/2015 Qing et al.
(Continued)

FOREIGN PATENT DOCUMENTS

CN 201877107 U 6/2011
CN 103440843 A 12/2013
(Continued)

OTHER PUBLICATIONS

First Office Action for Chinese Application No. 201710684866.2, dated Feb. 2, 2019, 12 Pages.
(Continued)

*Primary Examiner* — Temesghen Ghebretinsae
*Assistant Examiner* — Sosina Abebe
(74) *Attorney, Agent, or Firm* — Brooks Kushman P.C.

(57) ABSTRACT

The present disclosure provides a pixel unit circuit, a pixel circuit, a driving method and a display device. The pixel unit circuit includes: a light-emitting component with a first terminal coupled with a first voltage input terminal; a storage capacitor module; a driver transistor; a light-emitting control circuit with a control terminal coupled with a light-emitting control line, a first terminal coupled with a second voltage input terminal and a second terminal coupled with a second electrode of the driver transistor, where the light-
(Continued)

emitting control circuit is to, under control of the light-emitting control line, control whether the second electrode of the driver transistor is coupled with the second voltage input terminal; a charging compensation control circuit configured to, under control of a gate line, control whether a gate electrode of the driver transistor is coupled with a data line; and a voltage control circuit coupled with the first voltage input terminal and configured to control a voltage value of a first voltage input to the first voltage input terminal.

19 Claims, 5 Drawing Sheets

(52) U.S. Cl.
CPC ..... *G09G 2320/066* (2013.01); *G09G 2320/0626* (2013.01)

(58) Field of Classification Search
CPC ... G09G 2300/0866; G09G 2310/0262; G09G 2320/0626; G09G 2320/066; G09G 3/3233
See application file for complete search history.

(56) References Cited

U.S. PATENT DOCUMENTS

| | | | | |
|---|---|---|---|---|
| 2015/0302799 | A1* | 10/2015 | Feng | G09G 3/3233 345/76 |
| 2017/0177139 | A1 | 6/2017 | Yang et al. | |
| 2018/0158401 | A1* | 6/2018 | Wang | G09G 3/3225 |

FOREIGN PATENT DOCUMENTS

| | | | |
|---|---|---|---|
| CN | 103971636 | A | 8/2014 |
| CN | 104881179 | A | 9/2015 |
| CN | 105047138 | A | 11/2015 |
| CN | 106910459 | A | 6/2017 |
| CN | 107424570 | A | 12/2017 |

OTHER PUBLICATIONS ntemational Search Report and Written Opinion for Application No. PCT/CN2018/092130, dated Aug. 31, 2018, 11 Pages.
1st Chinese Office Action, English Translation.
International Search Report and Written Opinion, English Translation.

* cited by examiner

PIXEL UNIT CIRCUIT, PIXEL CIRCUIT, DRIVING METHOD AND DISPLAY DEVICE

CROSS-REFERENCE TO RELATED APPLICATIONS

This application is the U.S. national phase of PCT Application No. PCT/CN2018/092130 filed on Jun. 21, 2018, which claims priority to Chinese Patent Application No. 201710684866.2 filed on Aug. 11, 2017, which are incorporated herein by reference in their entireties.

TECHNICAL FIELD

The present disclosure relates to the field of display technologies, and in particular to a pixel unit circuit, a pixel circuit, a driving method and a display device.

BACKGROUND

Silicon-based organic light emitting diode (OLED) micro-display devices are at an intersection of microelectronics and optoelectronics, combines OLED technology and complementary metal oxide semiconductor (CMOS) technology, and are a cross-integration of optoelectronics and microelectronics. They have promoted development of a new generation of micro-display devices, as well as research and development of organic electrons on silicon and even molecular electrons on silicon.

Silicon-based OLED micro-display devices in the related art cannot effectively adjust brightness of micro OLEDS themselves and have problems that there are dynamic ghost images, brightness of OLEDs cannot be effectively improved due to a narrow data voltage range on data lines and it is impossible to switch between a high brightness mode and a high contrast mode.

SUMMARY

The present disclosure provides a pixel unit circuit that includes: a light-emitting component with a first terminal coupled with a first voltage input terminal; a storage capacitor module with a first terminal coupled with a direct current voltage input terminal; a driver transistor with a gate electrode coupled with a second terminal of the storage capacitor module, and a first electrode coupled with a second terminal of the light-emitting component; a light-emitting control circuit with a control terminal coupled with a light-emitting control line, a first terminal coupled with a second voltage input terminal and a second terminal coupled with a second electrode of the driver transistor; where the light-emitting control circuit is configured to, under control of the light-emitting control line, control whether the second electrode of the driver transistor is coupled with the second voltage input terminal; a charging compensation control circuit that is coupled with a gate line, a data line and the gate electrode of the driver transistor, respectively; wherein the charging compensation control circuit is configured to, under control of the gate line, control whether the gate electrode of the driver transistor is coupled with the data line; and a voltage control circuit coupled with the first voltage input terminal and configured to control a voltage value of a first voltage input to the first voltage input terminal.

In implementation, the voltage control circuit includes: a controller configured to, according to different display modes, output a corresponding display control signal; and, a direct current transformer coupled with the controller and configured to, based on the display control signal, input the first voltage of a corresponding voltage value to the first voltage input terminal.

In implementation, the pixel unit circuit further includes a reset circuit that is coupled with the light-emitting control line, the first electrode of the driver transistor and a reset voltage input terminal, respectively. The reset circuit is configured to, under control of the light-emitting control line, control whether the first electrode of the driver transistor is coupled with the reset voltage input terminal.

In implementation, the reset circuit includes a reset switching transistor with a gate electrode coupled with the light-emitting control line, a first electrode coupled with the first electrode of the driver transistor and a second electrode coupled with the reset voltage input terminal.

In implementation, the light-emitting control circuit includes a light-emitting control transistor with a gate electrode coupled with the light-emitting control line, a first electrode coupled with the second voltage input terminal and a second electrode coupled with the second electrode of the driver transistor. One of the light-emitting control transistor and the reset switching transistor is a p-type transistor, and the other of the light-emitting control transistor and the reset switching transistor is an n-type transistor.

In implementation, the gate line includes a first gate switch line and a second gate switch line. The charging compensation control circuit includes: a first charging compensation control transistor with a gate electrode coupled with the first gate switch line, a first electrode coupled with the gate electrode of the driver transistor and a second electrode coupled with the data line; and, a second charging compensation control transistor with a gate electrode coupled with the second gate switch line, a first electrode coupled with the data line and a second electrode coupled with the gate electrode of the driver transistor. The first charging compensation control transistor is an n-type transistor, and the second charging compensation control transistor is a p-type transistor.

In implementation, the light-emitting component includes an organic light emitting diode; a cathode of the organic light emitting diode is the first terminal of the light-emitting component; and an anode of the organic light emitting diode is the second terminal of the light-emitting component.

The present disclosure provides a pixel unit circuit driving method for driving the above pixel unit circuit, including: at a charging compensation stage in each display period, under control of the light-emitting control line, controlling, by the light-emitting control circuit, the second electrode of the driver transistor to be coupled with the second voltage input terminal; under control of the gate line, controlling, by the charging compensation control circuit, the data voltage Vdata of the data line to be written into the gate electrode of the driver transistor, thereby enabling the driver transistor to be turned on until a potential of the first electrode of the driver transistor is changed to be Vdata-Vth so that the driver transistor works in a constant current zone, where Vth is a threshold voltage of the driver transistor; and, at a pixel emission stage in each display period, controlling, by the voltage control circuit, a voltage value of a first voltage input into the first voltage input terminal; under control of the light-emitting control line, controlling, by the light-emitting control circuit, the second electrode of the driver transistor to be coupled with the second voltage input terminal so that the driver transistor works in the constant current zone and drives the light-emitting component to emit light.

In implementation, the voltage control circuit includes: a controller and a direct current transformer, controlling, by the voltage control circuit, the voltage value of the first voltage input into the first voltage input terminal, includes: outputting, by the controller, a display control signal according to different display modes; and inputting, by the direct current transformer, the first voltage of a corresponding voltage value to the first voltage input terminal based on the display control signal.

In implementation, the pixel unit circuit further includes a reset circuit that is coupled with the light-emitting control line, the first electrode of the driver transistor and a reset voltage input terminal, respectively, and that is configured to control whether the first electrode of the driver transistor is coupled with the reset voltage input terminal under control of the light-emitting control line, each display period further includes a display stage before the charging compensation stage, and the pixel unit circuit driving method further includes: at the reset stage, under control of the light-emitting control line, controlling, by the reset circuit, the first electrode of the driver transistor to be coupled with the reset voltage input terminal, thereby resetting the potential of the first electrode of the driver transistor; at the charging compensation stage and the pixel emission stage, under control of the light-emitting control line, controlling, by the reset circuit, disconnecting the first electrode of the driver transistor from the reset voltage input terminal.

In implementation, the reset circuit includes a reset switching transistor with a gate electrode coupled with the light-emitting control line, a first electrode coupled with the first electrode of the driver transistor and a second electrode coupled with the reset voltage input terminal, Vdata-Vth-Vc is greater than −Vn and less than Vn, where Vc is a voltage value of a reset voltage input from the reset voltage input terminal, and Vn is a withstand voltage value between the source electrode and the drain electrode of the reset switching transistor.

In implementation, the method further includes: at the reset stage, enabling a difference between a potential Vc of the second electrode of the light-emitting component and a voltage value Vi1 of the first voltage input to the first voltage input terminal under control of the voltage control circuit, to be less than a turn-on voltage of the light-emitting component.

The present disclosure provides a pixel circuit that includes: a plurality of rows of gate lines; a plurality of columns of data lines; a plurality of rows of light-emitting control lines; an array of the above pixel unit circuits. The pixel unit circuits in an identical row are coupled with an identical row of gate line, and the pixel unit circuits in an identical column are coupled with an identical column of data line.

The present disclosure provides a display device that includes the above pixel unit circuit.

In implementation, the display device further includes a silicon substrate; wherein the pixel unit circuit is disposed at the silicon substrate.

DETAILED DESCRIPTION

Technical solutions of embodiments of the present disclosure will be clearly and completely described hereinafter in conjunction with drawings of embodiments of the present disclosure. Apparently, the embodiments described hereinafter are only some embodiments of the present disclosure, rather than all embodiments. Based on the embodiments of the present disclosure, all other embodiments obtained by a person of ordinary skill in the art without creative work fall within the scope of the present disclosure.

Transistors adopted in all embodiments of the present disclosure may be thin film transistors, field effect transistors or other devices with the same characteristics. In embodiments of the present disclosure, in order to distinguish two electrodes of one transistor except for a gate electrode, one of the two electrodes may be referred as a first electrode and the other may be referred as a second electrode. In actual implementation, the first electrode may be a drain electrode, and the second electrode may be a source electrode; or, the first electrode may be a source electrode, and the second electrode may be a drain electrode.

Figure 1:
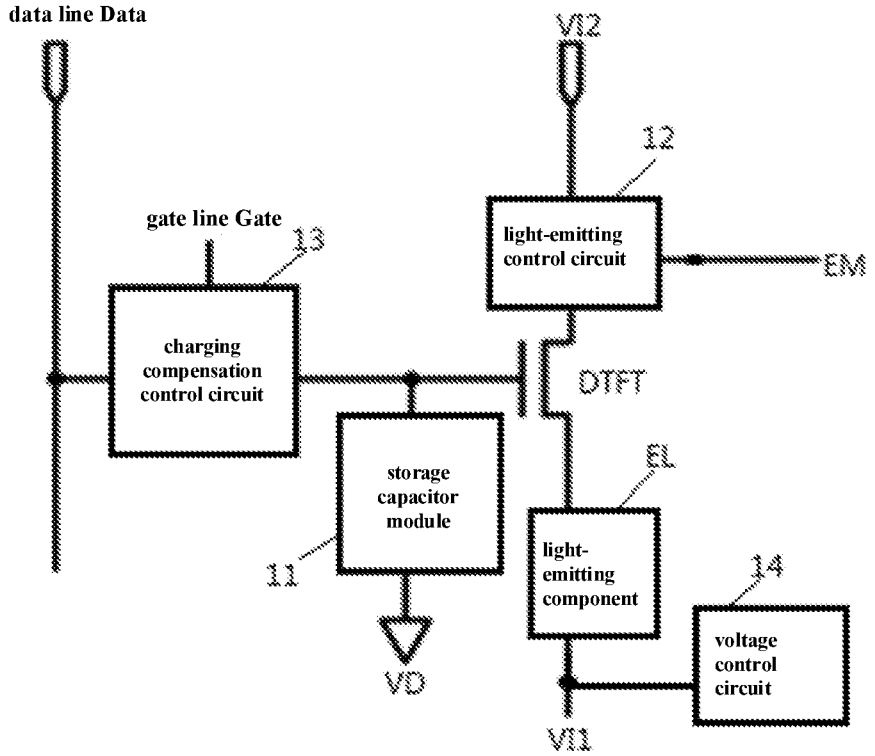
FIG. 1 is a schematic diagram of a pixel unit circuit according to an embodiment of the present disclosure.

As shown in FIG. 1, a pixel unit circuit of one embodiment of the present disclosure includes:

a light-emitting component EL with a first terminal coupled with a first voltage input terminal VI1;

a storage capacitor module 11 with a first terminal coupled with a direct current voltage input terminal VD;

a driver transistor DTFT with a gate electrode coupled with a second terminal of the storage capacitor module 11, and a first electrode coupled with a second terminal of the light-emitting component EL;

a light-emitting control circuit 12 with a control terminal coupled with a light-emitting control line EM, a first terminal coupled with a second voltage input terminal VI2 and a second terminal coupled with a second electrode of the driver transistor DTFT; where the light-emitting control circuit 12 is used to, under control of the light-emitting control line EM, control whether the second electrode of the driver transistor DTFT is coupled with the second voltage input terminal VI2;

a charging compensation control circuit 13 that is coupled with a gate line Gate, a data line Data and the gate electrode of the driver transistor DTFT, respectively; where the charging compensation control circuit 13 is used to, under control of the gate line Gate, control whether the gate electrode of the driver transistor DTFT is coupled with the data line Data; and a voltage control circuit 14 coupled with the first voltage input terminal VI1 and used to control a voltage value of a first voltage input to the first voltage input terminal VI1.

According to the pixel unit circuit of one embodiment of the present disclosure, a data voltage Vdata on the data line Data may be adjusted (with timing cooperation, enabling the charging compensation control circuit to control a potential of the second terminal of the light-emitting component to be Vdata-Vth at a charging compensation stage, where Vth is a threshold voltage of DTFT) to effectively adjust brightness of the light-emitting component itself. Further, switching between a high brightness mode and a high contrast mode may be realized by using the voltage control circuit to adjust the voltage value of the first voltage input to the first voltage input terminal.

One embodiment shown in FIG. 1 is illustrated by taking the DTFT being a n-type transistor as an example.

According to an exemplary embodiment, the voltage control circuit may include: a controller used to, according to different display modes, output a corresponding display control signal; and, a direct current transformer coupled with the controller and used to, based on the display control signal, input the first voltage of a corresponding voltage value to the first voltage input terminal.

Figure 6:
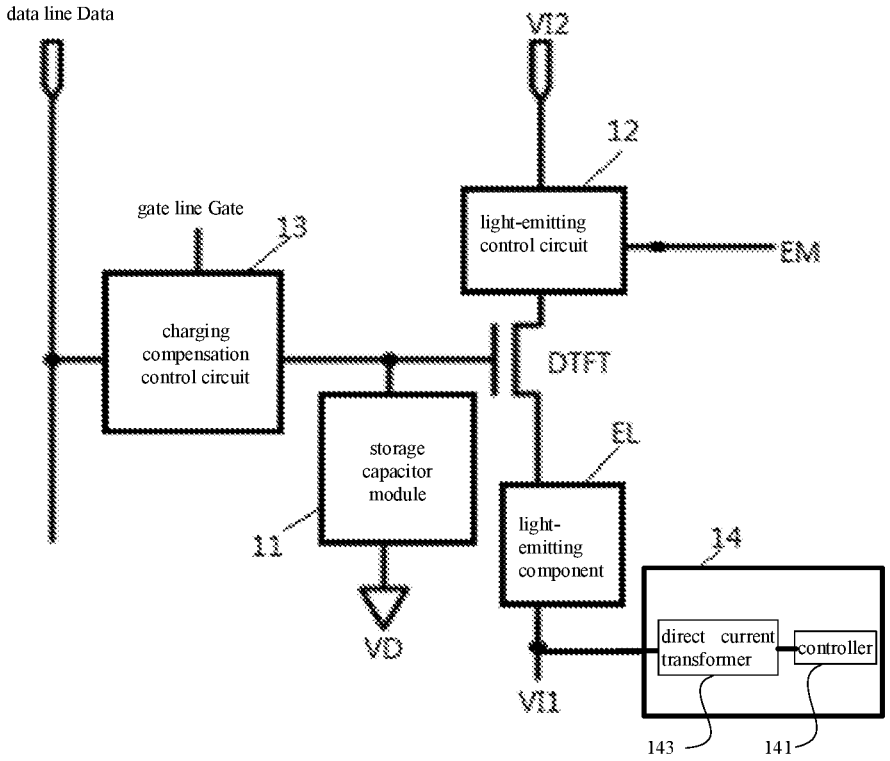
FIG. 6 is a schematic diagram of a pixel unit circuit according to an embodiment of the present disclosure.

In actual operation, as shown in FIG. 6, the voltage control circuit may include: a controller 141 and a direct current transformer 143. The controller outputs a display control signal according to different display modes. The direct current transformer inputs the first voltage of a corresponding voltage value to the first voltage input terminal based on the display control signal. In some embodiments, the controller may be implemented as a processor.

Figure 2:
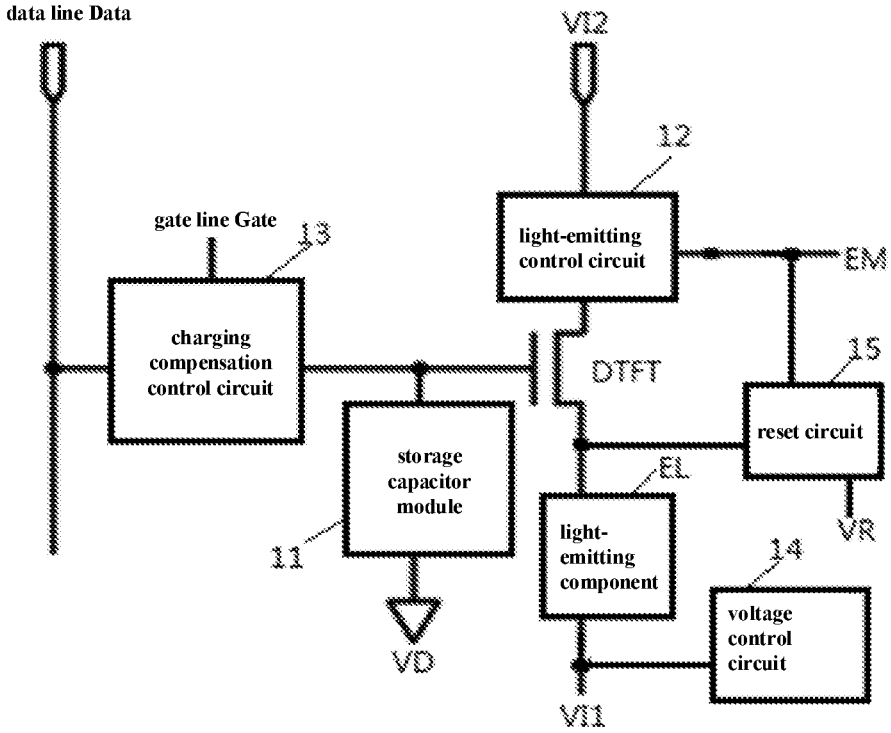
FIG. 2 is a schematic diagram of a pixel unit circuit according to another embodiment of the present disclosure.

Optionally, as shown in FIG. 2, the pixel unit circuit of one embodiment of the present disclosure further includes a reset circuit 15 that is coupled with the light-emitting control line EM, the first electrode of the driver transistor DTFT and a reset voltage input terminal VR for inputting a reset voltage, respectively. The reset circuit 15 is used to, under control of the light-emitting control line EM, control whether the first electrode of the driver transistor DTFT is coupled with the reset voltage input terminal VR for inputting the reset voltage. At a reset stage, the reset circuit 15 may control to eliminate the voltage remaining in the second terminal of the light-emitting component in a previous frame, thereby eliminating dynamic afterimages. Specifically, the reset circuit may include a reset switching transistor with a gate electrode coupled with the light-emitting control line, a first electrode coupled with the first electrode of the driver transistor and a second electrode coupled with the reset voltage input terminal.

Specifically, the light-emitting control circuit may include a light-emitting control transistor with a gate electrode coupled with the light-emitting control line, a first electrode coupled with the second voltage input terminal and a second electrode coupled with the second electrode of the driver transistor.

When the light-emitting control transistor is a p-type transistor, the reset switching transistor may be an n-type transistor. When the light-emitting control transistor is an n-type transistor, the reset switching transistor may be a p-type transistor.

Optionally, the gate line may include a first gate switch line and a second gate switch line.

The charging compensation control circuit includes: a first charging compensation control transistor with a gate electrode coupled with the first gate switch line, a first electrode coupled with the gate electrode of the driver transistor and a second electrode coupled with the data line; and, a second charging compensation control transistor with a gate electrode coupled with the second gate switch line, a first electrode coupled with the data line and a second electrode coupled with the gate electrode of the driver transistor; where the first charging compensation control transistor is an n-type transistor, and the second charging compensation control transistor is a p-type transistor.

The charging compensation control circuit of one embodiment of the present disclosure includes one n-metal-oxide-semiconductor (NMOS) tube and one p-metal-oxide-semiconductor (PMOS) tube, thereby increasing the data voltage range on the data line and improving brightness of the light-emitting component.

In actual operation, if one charging compensation control circuit includes only one first charging compensation control transistor, then when a potential of a signal output from the first gate switch line is not high enough, a higher data voltage output by the data line may not be transmitted to the gate electrode of the driver transistor. While in one embodiment of the present disclosure, the charging compensation control circuit further includes the second charging compensation control transistor. When the second gate switch line outputs a signal of low level at the charging compensation stage, even if the data voltage output by the data line may be higher, the presence of the second charging compensation control transistor can ensure that the data voltage can be written into the gate electrode of the driver transistor, thereby increasing an effective drive voltage range on the data line.

Specifically, the light-emitting component may include an organic light emitting diode. A cathode of the organic light emitting diode is the first terminal of the light-emitting component, and an anode of the organic light emitting diode is the second terminal of the light-emitting component.

In actual operation, the storage capacitor module may include a storage capacitor.

The pixel unit circuit of the present disclosure will be illustrated hereinafter with an exemplary embodiment.

Figure 3:
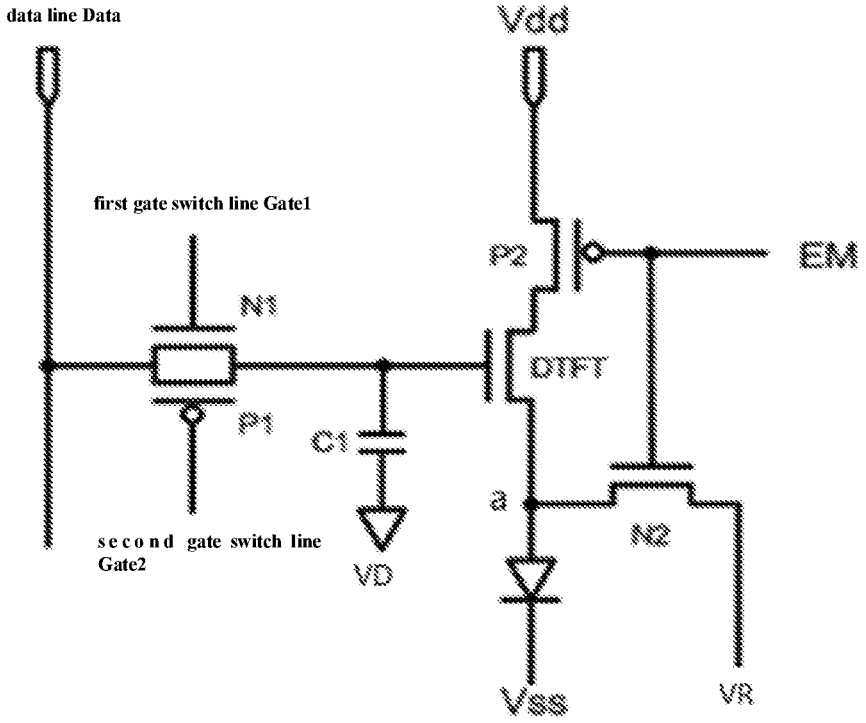
FIG. 3 is a circuit diagram of a specific embodiment of a pixel unit circuit according to the present disclosure.

As shown in FIG. 3, a pixel unit circuit according to an exemplary embodiment of the present disclosure includes an organic light emitting diode OLED, a storage capacitor C1, a driver transistor DTFT, a light-emitting control circuit, a charging compensation control circuit, a voltage control circuit and a reset circuit.

An anode of the organic light emitting diode OLED is coupled with a drain electrode of the driver transistor DTFT. A cathode of the organic light emitting diode OLED is coupled with a low-level input terminal for inputting a low level Vss.

A first terminal of the storage capacitor C1 is coupled with a direct current voltage input terminal VD. A second terminal of the storage capacitor C1 is coupled with a gate electrode of the driver transistor DTFT.

The charging compensation control circuit includes: a first charging compensation control transistor N1, with a gate electrode coupled with a first gate switch line Gate1, a source electrode coupled with the gate electrode of the driver transistor DTFT and a drain electrode coupled with a data line Data; and, a second charging compensation control transistor P1 with a gate electrode coupled with a second gate switch line Gate2, a source electrode coupled with the data line Data and a drain electrode coupled with the gate electrode of the driver transistor DTFT.

The reset circuit includes a reset switching transistor N2 with a gate electrode coupled with a light-emitting control line EM, a source electrode coupled with the source electrode of the driver transistor DTFT and a drain electrode coupled with a reset voltage input terminal VR.

The light-emitting control circuit includes a light-emitting control transistor P2 with a gate electrode coupled with the light-emitting control line EM, a source electrode coupled with a high-level input terminal for inputting a high level Vdd, and a second electrode coupled with the source electrode of the driver transistor DTFT.

The voltage control circuit (not shown in FIG. 3) is coupled with the low-level input terminal for inputting the low level Vss, and is used to control a voltage value of the low level Vss input to the low-level input terminal.

The first charging compensation control transistor N1 is an n-type transistor. The second charging compensation control transistor P1 is a p-type transistor. The reset switching transistor N2 is an n-type transistor. The light-emitting control transistor P2 is a p-type transistor. The driver transistor DTFT is an n-type transistor.

In FIG. 3, the point a is a node that is coupled with the anode of the organic light emitting diode OLED.

Figure 4:
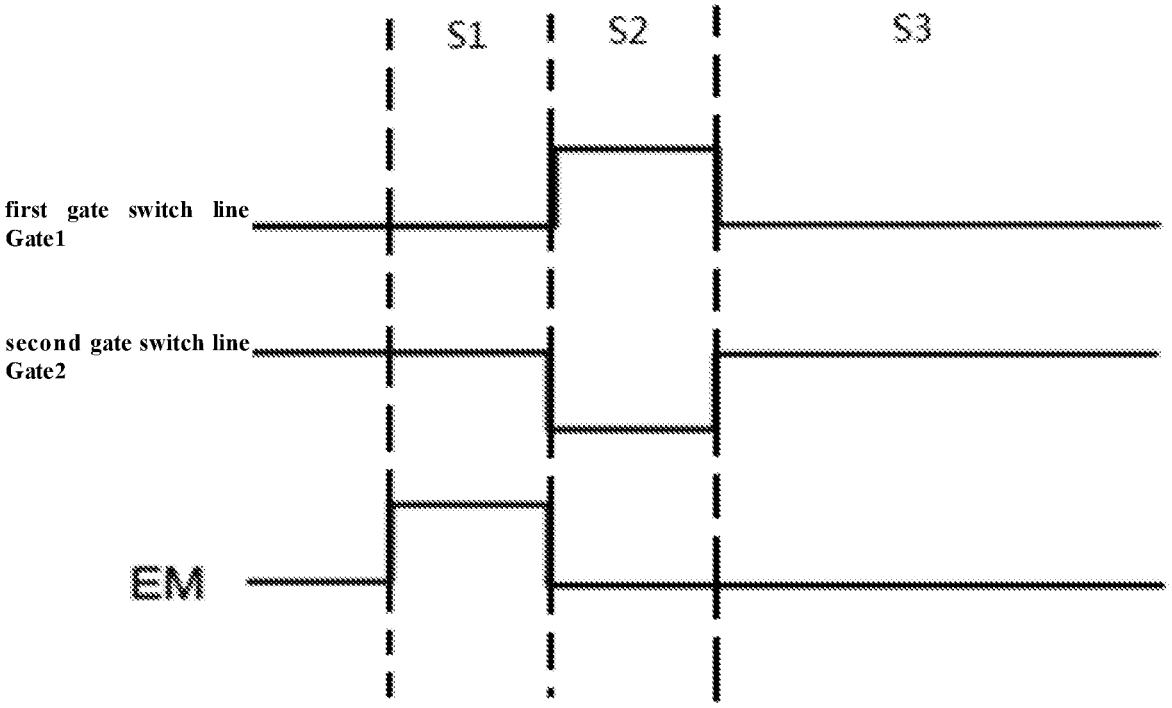
FIG. 4 is a working sequence diagram of the specific embodiment of the pixel unit circuit shown in FIG. 3 according to the present disclosure.
Figure 5A:
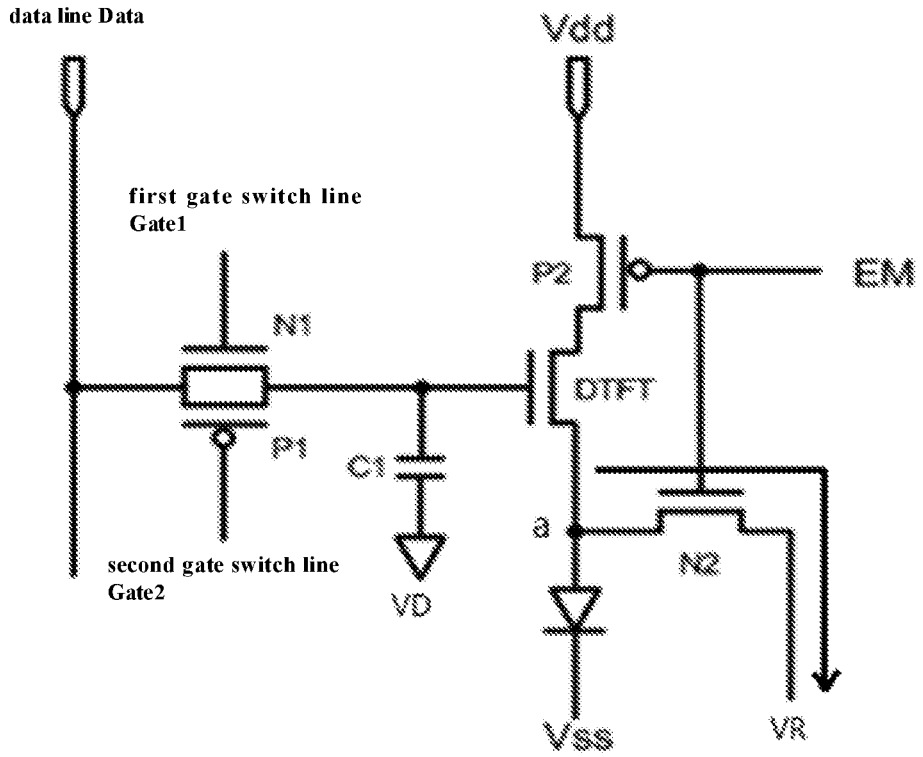
FIG. 5A is a schematic working diagram of the specific embodiment of the pixel unit circuit shown in FIG. 3 at a reset stage according to the present disclosure.

As shown in FIG. 4, when the pixel unit circuit shown in FIG. 3 works, at a reset stage S1, Gate1 outputs a low level, Gate2 and EM each outputs a high level; further referring to FIG. 5A, P1, P2 and N1 are turn off, N2 is turn on, thereby controlling the drain electrode of the driver transistor DTFT to be coupled with the reset voltage input terminal VR to reset a potential of the drain electrode of the driver transistor DTFT.

Figure 5B:
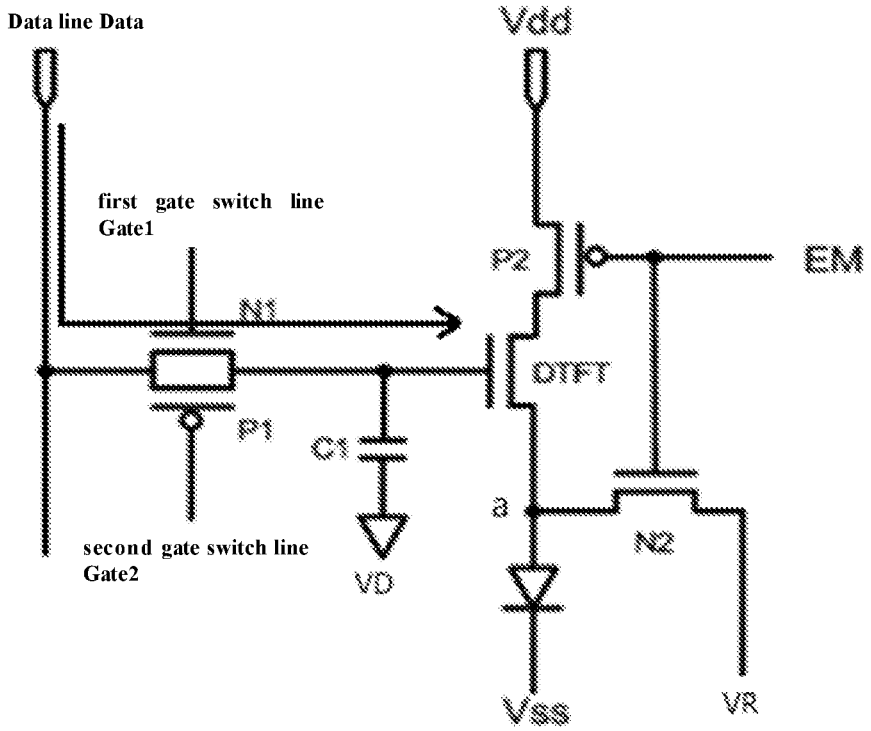
FIG. 5B is a schematic working diagram of the specific embodiment of the pixel unit circuit shown in FIG. 3 at a charging compensation stage according to the present disclosure.

At a charging compensation stage S2, Gate1 outputs a high level, Gate2 and EM each outputs a low level; further referring to FIG. 5B, P1, P2 and N1 are turn on, N2 is turn off, so that a data voltage Vdata output from Data charges the gate electrode of the driver transistor DTFT through C1 until a potential of the second terminal of C1 is Vdata. At this point, DTFT first is turned on until a potential of the point a is Vdata-Vth, and DTFT works in a constant current zone (approximate constant current zone). The presence of N1 and P1 in this embodiment is mainly used to increase an effective drive voltage range on Dara. Vth is a threshold voltage of DTFT.

Figure 5C:
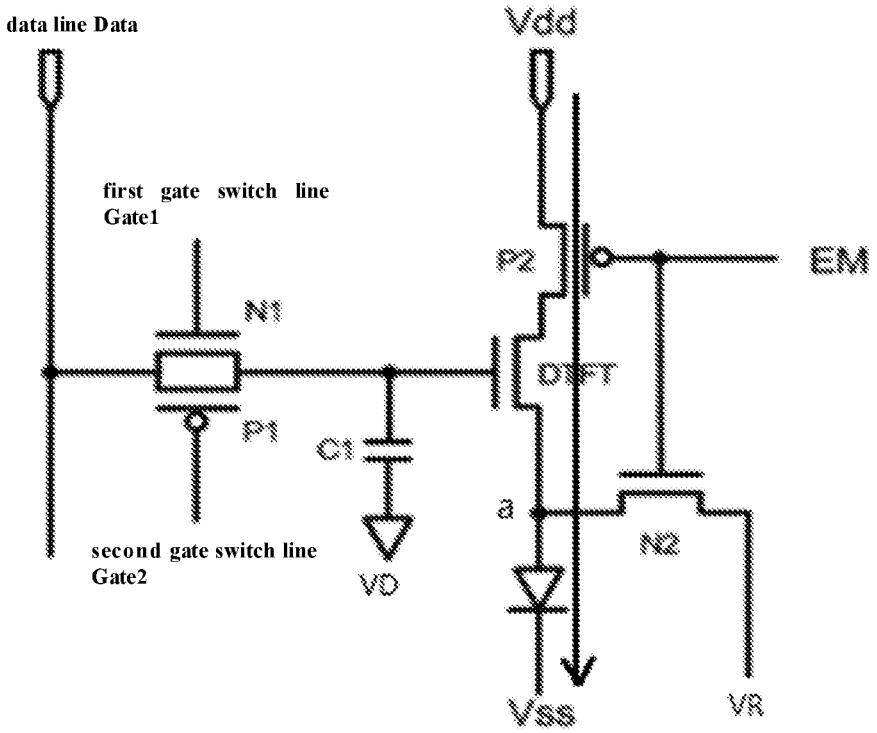
FIG. 5*c* is a schematic working diagram of the specific embodiment of the pixel unit circuit shown in FIG. 3 at a pixel emission stage according to the present disclosure.

At a pixel lighting stage S3, Gate1 and EM each outputs a low level, Gate2 outputs a high level; further referring to FIG. 5C, P2 is turned on, N1, P1 and N2 are turned off, the potential of the point a remains at Vdata-Vth. At this point, the drain electrode of DTFT receives Vdd, and DTFT works in a constant current zone (approximate constant current zone). OLED is driven to emit light by the current that flows through the turned on P2 and the DTFT which works in the constant current zone. According to the pixel unit circuit of one embodiment of the present disclosure, the potential of the point a is adjusted by controlling the potential of the gate electrode of the DTFT, thereby adjusting voltages at two ends of the OLED and then adjusting luminous current of the OLED.

In actual implementation, the pixel unit circuit of one embodiment of the present disclosure may be disposed at a silicon substrate. One embodiment of the present disclosure provides a silicon-based organic light-emitting diode (OLED) pixel driving circuit. The silicon-based organic light-emitting diode pixel driving circuit, by matching a new timing in combination with its own pixel-driven design, can effectively adjust the brightness of the micro OLED itself and can also improve the problem of dynamic afterimages. Further, for the pixel unit circuit itself, the special gate electrode of TFT can increase the data voltage range and improve brightness of OLED.

In the pixel unit circuit shown in FIG. 3 according to one exemplary embodiment of the present disclosure, when TFT selects 6V (volt) process (i.e., an absolute value of a voltage difference between any two electrodes of each transistor in the pixel unit circuit shown in FIG. 3 according to one exemplary embodiment of the present disclosure cannot exceed 6V), when Vdata is greater than or equal to 0V and less than or equal to 5V and when the threshold voltage of the driver transistor DTFT is greater than or equal to 1V and less than or equal to 2V, the potential of the point a is greater than or equal to −1V and less than or equal to 4V. At this point, if the voltage value of Vss is −5V, the cross-voltage between the anode and the cathode of the OLED is greater than or equal to 4V and less than or equal to 9V, and then the pixel unit circuit works in the high brightness mode. As can be seen from the above that when the voltage control circuit control to change the voltage value of Vss, the cross-voltage between the anode and the cathode of the OLED is changed, thereby changing the operating mode of the pixel unit circuit.

It is noteworthy that when the potential of the point a is greater than or equal to −1V and less than or equal to 4V, a voltage difference between the potential Vdata-Vth of the source electrode of N2 and the potential Vc (which is the voltage value of the reset voltage input from the reset voltage input terminal VR) of the drain electrode of N2 is Vdata-Vth-Vc. It is needed to ensure that Vdata-Vth-Vc is greater than −Vn and less than Vn, where Vn is a withstand voltage value between the source electrode and the drain electrode of N2. The withstand voltage value refers to a highest value of a voltage difference between a voltage of a source electrode of a transistor and a voltage of a drain electrode of the transistor, and the transistor may be damage when the voltage difference between the voltage of the source electrode of the transistor and the voltage of the drain electrode of the transistor is greater than the withstand voltage value. For example, Vn may be 6V; in actual implementation, Vn may also be other voltage value.

As can be seen from the above that in actual implementation, it is assumed that the voltage value of Vss is greater than or equal to −5V and less than or equal to −2V, the voltage value Vc of the reset voltage input from the reset voltage input terminal VR is equal to the voltage value of Vss, and Vn is 6V, then the potential of the point a is greater than or equal to −1V and less than or equal to 4V. Then, at the reset stage, the cross-voltage between the anode and the cathode of the OLED may be greater than a turn-on voltage of the OLED. At this point, at the reset stage, it is needed to use the voltage control circuit to control adjustment of the voltage value V1 of Vss, thereby enabling a difference between the potential Vc of the anode of the OLED and the potential V1 of the cathode of the OLED to be less than the turn-on voltage of the OLED and then enabling the OLED to not emit light at the reset stage. In this way, it is ensured that the OLED cannot emit light at the reset stage, thereby eliminating dynamic ghost images.

One embodiment of the present disclosure provides a pixel unit circuit driving method, which is used to drive the above pixel unit circuit. The pixel unit circuit driving method includes: at a charging compensation stage in each display period, under control of the light-emitting control line, the light-emitting control circuit controls the second electrode of the driver transistor to be coupled with the second voltage input terminal; under control of the gate line, the charging compensation control circuit controls the data voltage Vdata of the data line to be written into the gate electrode of the driver transistor, thereby enabling the driver transistor to be turned on until the potential of the first electrode of the driver transistor is changed to be Vdata-Vth and then the driver transistor works in the constant current zone, where Vth is the threshold voltage of the driver transistor; and, at a pixel emission stage in each display period, the voltage control circuit controls a voltage value of a first voltage input into the first voltage input terminal; under control of the light-emitting control line, the light-emitting control circuit controls the second electrode of the driver transistor to be coupled with the second voltage input terminal and then the driver transistor works in the constant current zone and drives the light-emitting component to emit light.

When the pixel unit circuit driving method according to one embodiment of the present disclosure is carried out, at the pixel emission stage, the voltage control circuit controls the voltage value of the first voltage input into the first voltage input terminal, thereby adjusting the cross voltage at two ends of the light-emitting component and then realizing switching between a high brightness mode and a high contrast mode.

Specifically, when the voltage control circuit includes: a controller and a direct current transformer, the step that the voltage control circuit controls the voltage value of the first voltage input into the first voltage input terminal, includes: outputting, by the controller, a display control signal according to different display modes; and inputting, by the direct current transformer, the first voltage of a corresponding voltage value to the first voltage input terminal based on the display control signal.

Specifically, when the pixel unit circuit further includes a reset circuit that is coupled with the light-emitting control line, the first electrode of the driver transistor and a reset voltage input terminal, respectively, and that is used to control whether the first electrode of the driver transistor is coupled with the reset voltage input terminal under control of the light-emitting control line, each display period further includes a display stage before the charging compensation stage, and the pixel unit circuit driving method further includes: at a reset stage, under control of the light-emitting control line, controlling, by the reset circuit, the first electrode of the driver transistor to be coupled with the reset voltage input terminal, thereby resetting the potential of the first electrode of the driver transistor; at the charging compensation stage and the pixel emission stage, under control of the light-emitting control line, controlling, by the reset circuit, disconnecting the first electrode of the driver transistor from the reset voltage input terminal.

Specifically, when the reset circuit includes a reset switching transistor with a gate electrode coupled with the light-emitting control line, a first electrode coupled with the first electrode of the driver transistor and a second electrode coupled with the reset voltage input terminal, Vdata-Vth-Vc is greater than −Vn and less than Vn, where Vn is a withstand voltage value between the source electrode and the drain electrode of the reset switching transistor.

In actual implementation, the voltage difference between the source electrode of the reset switching transistor and the drain electrode of the reset switching transistor is needed to be less than the withstand voltage value between the source electrode and the drain electrode of the reset switching transistor, thereby realizing high-voltage light-emitting drive scheme under low-voltage TFT process and achieving high brightness.

Optionally, the pixel unit circuit driving method according to one embodiment of the present disclosure further includes: at the reset stage, enabling a difference between a potential Vc of the second electrode of the light-emitting component and a voltage value Vi1 of the first voltage input to the first voltage input terminal under control of the voltage control circuit, to be less than the turn-on voltage of the light-emitting component.

At the reset stage, it is needed to use the voltage control circuit to adjust the voltage value of the first voltage input to the first voltage input terminal, thereby enabling the cross voltage at two ends of the light-emitting component to be less than the turn-on voltage of the light-emitting component, then enabling the light-emitting component to not emit light at the reset stage and then eliminating dynamic ghost images.

Figure 7:
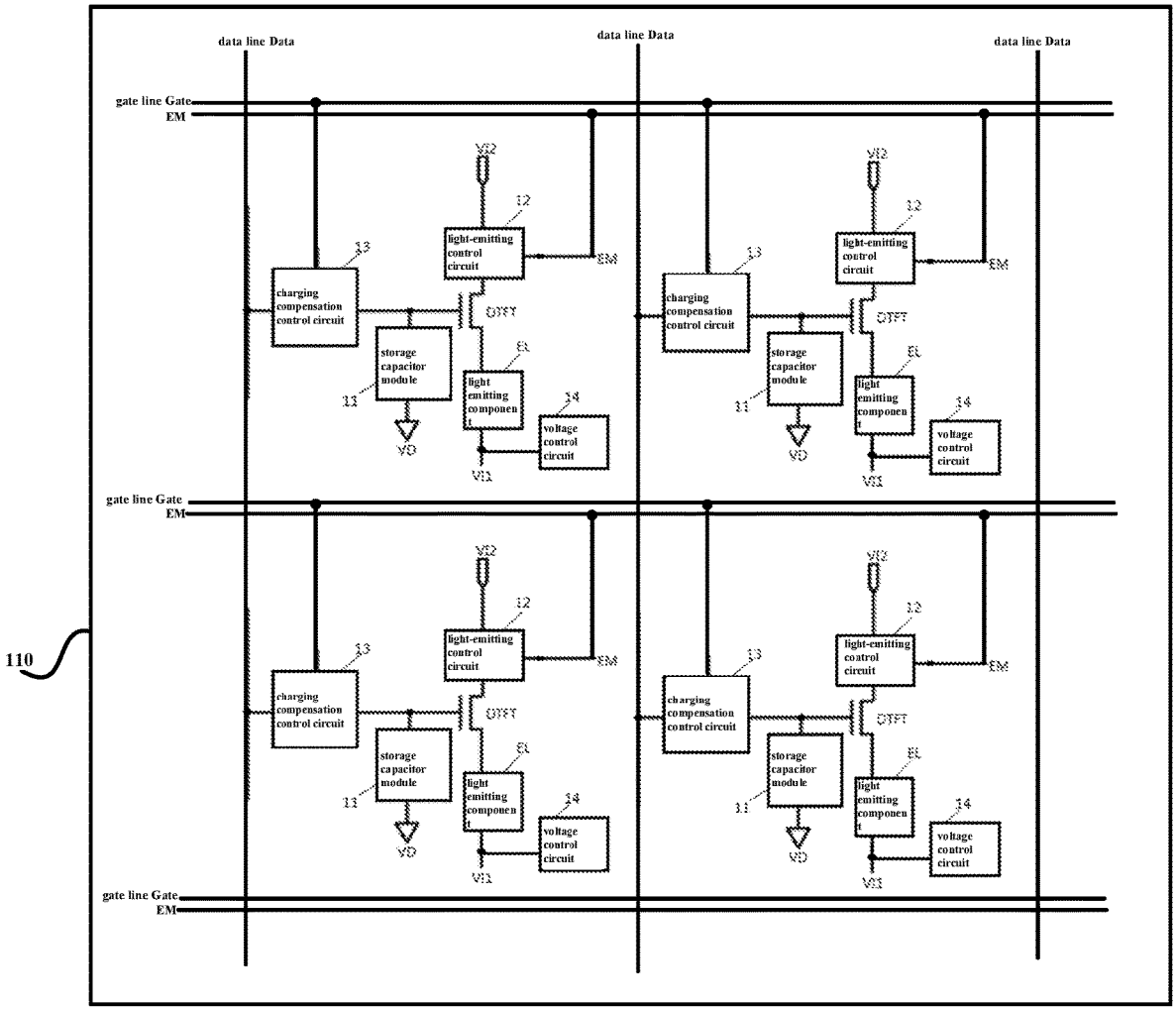
FIG. 7 is a schematic diagram of a pixel circuit according to an embodiment of the present disclosure.

As shown in FIG. 7, one embodiment of the present disclosure provides a pixel circuit that includes a plurality of rows of gate lines Gate, a plurality of columns of data lines Data, a plurality of rows of light-emitting control lines EM and a plurality of above pixel unit circuits which are arranged in an array. The pixel unit circuits in an identical row are coupled with an identical row of gate line. The pixel unit circuits in an identical column are coupled with an identical column of data line.

One embodiment of the present disclosure provides a display device that includes the above pixel unit circuit.

The display device according to one embodiment of the present disclosure may further include a silicon substrate 110. The pixel unit circuit is disposed at the silicon substrate.

The display device may be any product or component with display function, such as a television, a monitor, a digital photo frame, a mobile phone, a tablet computer.

The above are merely the optional embodiments of the present disclosure. It should be noted that, a person skilled in the art may make improvements and modifications without departing from the principle of the present disclosure, and these improvements and modifications shall also fall within the scope of the present disclosure.

What is claimed is:

1. A pixel unit circuit comprising:

a light-emitting component with a first terminal coupled with a first voltage input terminal;

a storage capacitor module with a first terminal coupled with a direct current voltage input terminal;

a driver transistor with a gate electrode coupled with a second terminal of the storage capacitor module, and a first electrode coupled with a second terminal of the light-emitting component;

a light-emitting control circuit with a control terminal coupled with a light-emitting control line, a first terminal coupled with a second voltage input terminal and a second terminal coupled with a second electrode of the driver transistor; wherein the light-emitting control circuit is configured to, under control of the light-emitting control line, control whether the second electrode of the driver transistor is coupled with the second voltage input terminal;

a charging compensation control circuit that is coupled with a gate line, a data line and the gate electrode of the driver transistor, respectively; wherein the charging compensation control circuit is configured to, under control of the gate line, control whether the gate electrode of the driver transistor is coupled with the data line; and a voltage control circuit coupled with the first voltage input terminal and configured to control a voltage value of a first voltage input to the first voltage input terminal;

wherein the pixel unit circuit further includes a reset circuit that is coupled with the light-emitting control line, the first electrode of the driver transistor and a reset voltage input terminal, respectively; wherein the reset circuit is configured to, under control of the light-emitting control line, control whether the first electrode of the driver transistor is coupled with the reset voltage input terminal;

wherein the reset circuit includes a reset switching transistor with a gate electrode coupled with the light-emitting control line, a first electrode coupled with the first electrode of the driver transistor and a second electrode coupled with the reset voltage input terminal;

wherein the light-emitting control circuit includes a light-emitting control transistor with a gate electrode coupled with the light-emitting control line, a first electrode coupled with the second voltage input terminal and a second electrode coupled with the second electrode of the driver transistor; and wherein one of the light-emitting control transistor and the reset switching transistor is a p-type transistor, and the other of the light-emitting control transistor and the reset switching transistor is an n-type transistor.

2. The pixel unit circuit of claim 1, wherein the voltage control circuit includes:

a controller configured to, according to different display modes, output a corresponding display control signal; and, a direct current transformer coupled with the controller and configured to, based on the display control signal, input the first voltage of a corresponding voltage value to the first voltage input terminal.

3. The pixel unit circuit of claim 1, wherein the gate line includes a first gate switch line and a second gate switch line;

the charging compensation control circuit includes:

a first charging compensation control transistor with a gate electrode coupled with the first gate switch line, a first electrode coupled with the gate electrode of the driver transistor and a second electrode coupled with the data line; and, a second charging compensation control transistor with a gate electrode coupled with the second gate switch line, a first electrode coupled with the data line and a second electrode coupled with the gate electrode of the driver transistor;

wherein the first charging compensation control transistor is an n-type transistor, and the second charging compensation control transistor is a p-type transistor.

4. The pixel unit circuit of claim 1, wherein the light-emitting component includes an organic light emitting diode; a cathode of the organic light emitting diode is the first terminal of the light-emitting component; and an anode of the organic light emitting diode is the second terminal of the light-emitting component.

5. A pixel unit circuit driving method for driving the pixel unit circuit of claim 1, comprising:

at a charging compensation stage in each display period, under control of the light-emitting control line, controlling, by the light-emitting control circuit, the second electrode of the driver transistor to be coupled with the second voltage input terminal; under control of the gate line, controlling, by the charging compensation control circuit, the data voltage Vdata of the data line to be written into the gate electrode of the driver transistor, thereby enabling the driver transistor to be turned on until a potential of the first electrode of the driver transistor is changed to be Vdata−Vth so that the driver transistor works in a constant current zone, where Vth is a threshold voltage of the driver transistor; and, at a pixel emission stage in each display period, controlling, by the voltage control circuit, a voltage value of a first voltage input into the first voltage input terminal; under control of the light-emitting control line, controlling, by the light-emitting control circuit, the second electrode of the driver transistor to be coupled with the second voltage input terminal so that the driver transistor works in the constant current zone and drives the light-emitting component to emit light.

6. The method of claim 5, wherein the voltage control circuit includes: a controller and a direct current transformer, controlling, by the voltage control circuit, the voltage value of the first voltage input into the first voltage input terminal, includes:

outputting, by the controller, a display control signal according to different display modes; and inputting, by the direct current transformer, the first voltage of a corresponding voltage value to the first voltage input terminal based on the display control signal.

7. The method of claim 5, wherein the pixel unit circuit further includes a reset circuit that is coupled with the light-emitting control line, the first electrode of the driver transistor and a reset voltage input terminal, respectively, and that is configured to control whether the first electrode of the driver transistor is coupled with the reset voltage input terminal under control of the light-emitting control line, each display period further includes a display stage before the charging compensation stage, and the pixel unit circuit driving method further includes:

at the reset stage, under control of the light-emitting control line, controlling, by the reset circuit, the first electrode of the driver transistor to be coupled with the reset voltage input terminal, thereby resetting the potential of the first electrode of the driver transistor; and at the charging compensation stage and the pixel emission stage, under control of the light-emitting control line, controlling, by the reset circuit, disconnecting the first electrode of the driver transistor from the reset voltage input terminal.

8. The method of claim 7, wherein the reset circuit includes a reset switching transistor with a gate electrode coupled with the light-emitting control line, a first electrode coupled with the first electrode of the driver transistor and a second electrode coupled with the reset voltage input terminal, Vdata−Vth−Vc is greater than −Vn and less than Vn, where Vc is a voltage value of a reset voltage input from the reset voltage input terminal, and Vn is a withstand voltage value between the source electrode and the drain electrode of the reset switching transistor.

9. The method of claim 8, further comprising: at the reset stage, enabling a difference between a potential Vc of the second electrode of the light-emitting component and a voltage value Vi1 of the first voltage input to the first voltage input terminal under control of the voltage control circuit, to be less than a turn-on voltage of the light-emitting component.

10. A pixel circuit comprising:

a plurality of rows of gate lines;

a plurality of columns of data lines;

a plurality of rows of light-emitting control lines;

an array of pixel unit circuits of claim 1;

wherein the pixel unit circuits in an identical row are coupled with an identical row of gate line, and the pixel unit circuits in an identical column are coupled with an identical column of data line.

11. A display device comprises the pixel unit circuit of claim 1.

12. The display device of claim 11, further comprising a silicon substrate; wherein the pixel unit circuit is disposed at the silicon substrate.

13. The pixel unit circuit of claim 1, wherein the gate electrode of the reset switching transistor and the gate electrode of the light-emitting control transistor are directly coupled with identical one light-emitting control line.

14. The pixel unit circuit of claim 1, wherein the gate electrode of the driver transistor is coupled with only the second terminal of the storage capacitor module and the charging compensation control circuit.

15. The pixel unit circuit of claim 1, wherein the gate electrode of the driver transistor is directly coupled with only the second terminal of the storage capacitor module and the charging compensation control circuit.

16. The pixel unit circuit of claim 15, wherein the second electrode of the driver transistor is directly coupled with only the second terminal of the light-emitting control circuit.

17. The pixel unit circuit of claim 16, wherein the first electrode of the driver transistor is directly coupled with the second terminal of the light-emitting component.

18. The pixel unit circuit of claim 3, wherein the gate electrode of the driver transistor is directly coupled with only the second terminal of the storage capacitor module, the first electrode of the first charging compensation control transistor and the second electrode of the second charging compensation control transistor.

19. The pixel unit circuit of claim 18, wherein the second electrode of the first charging compensation control transistor is directly coupled with the data line; and the first electrode of the second charging compensation control transistor is directly coupled with the data line.

* * * * *